US005601667A

United States Patent [19]

Takahashi et al.

[11] Patent Number: 5,601,667

[45] Date of Patent: Feb. 11, 1997

[54] PROCESS FOR PRODUCING HOT FORGED STEEL HAVING EXCELLENT FATIGUE STRENGTH, YIELD STRENGTH, AND MACHINABILITY

[75] Inventors: Toshihiko Takahashi, Chiba-ken; Tatsuro Ochi, Hokkaido; Fusao Ishikawa, Chiba-ken, all of Japan

[73] Assignee: Nippon Steel Corporation, Tokyo, Japan

[21] Appl. No.: 454,138

[22] Filed: Jun. 8, 1995

[30] Foreign Application Priority Data

Oct. 12, 1993 [JP] Japan ..... 5-254333

[51] Int. Cl.[6] ..... C21D 8/00

[52] U.S. Cl. ..... 148/649; 148/654

[58] Field of Search ..... 148/649, 654, 148/328

[56] References Cited

U.S. PATENT DOCUMENTS 5,041,167 8/1991 Miwa ..... 148/649

5,213,634 5/1993 DeArdo et al. ..... 148/334

*Primary Examiner*—Deborah Yee

*Attorney, Agent, or Firm*—Wenderoth, Lind & Ponack

[57] ABSTRACT

A process for producing a hot forged steel of ferrite+bainite structure type which is characterized by: applying hot forging to a steel product of a composition by weight of

C: 0.10–0.35%,

Si: 0.15–2.00%,

Mn: 0.40–2.00%,

S: 0.03–0.10%,

Al: 0.0005–0.050%,

Ti: 0.003–0.050%,

N: 0.0020–0.0070%,

V: 0.30–0.70%, and further containing one or more of Cr, Mo, Nb, Pb and Ca in a specified amount; cooling thereafter so that 80% or more of the metallographic structure after finishing of the transformation is ferrite+bainite structure; and further applying aging treatment at a temperature of 200°–700° C. According to the present invention, it is possible to produce a hot forged steel which has satisfactory fatigue strength, machinability and yield strength; its industrial advantages are enormous.

2 Claims, No Drawings

PROCESS FOR PRODUCING HOT FORGED STEEL HAVING EXCELLENT FATIGUE STRENGTH, YIELD STRENGTH, AND MACHINABILITY

TECHNICAL FIELD

The present invention relates to a production process for a steel for machine structural use including use for automobiles by hot forging. More specifically, the present invention relates to a production process for a hot forged steel that has excellent tensile strength, fatigue strength and machinability simultaneously by hot forging a steel product having a specific chemical composition to form a specified metallographic structure and applying aging treatment thereafter.

BACKGROUND ART

Non-thermal refined steels have been widely used for structural machine parts such as automobile parts from the standpoint of elimination of steps and reduction of production cost.

These non-thermal refined steels have been developed mainly for their high tensile strength (or hardness), yield strength and toughness. In this regard, as disclosed in Laid-Open Japanese Patent Application No. Sho 62-205245, for example, non-thermal refined steels have been proposed that utilize V, a typical element for precipitation strengthening. In application of such non-thermal refined steels having high strength and toughness as machine structural steel, however, the real problems are the fatigue strength and machinability.

Fatigue strength is generally understood to depend on the tensile strength and increases as the tensile strength increases. However, enhancement of tensile strength deteriorates the machinability extremely: with a tensile strength exceeding 120 kgf/mm$^2$, production with normal efficiency will be impossible. There has thus been eager demand to develop a non-thermal refined steel by improving fatigue strength without sacrificing the machinability.

For this purpose, it is an effective means to improve durability ratio, that is the ratio of the fatigue strength to the tensile strength. In this connection, a process to reduce the high carbon isle-like martensite and the retained austenite in the structure is proposed, for example in Japanese Laid-Open Patent Application No. Hei 4-176842, by transforming the metallographic structure into a structure mainly composed of bainite.

However, despite such efforts and other development trials the durability ratio has been improved to 0.55 at most and the machinability has been improved only twice or so compared with the conventional type bainite non-thermal refined steels having extremely poor machinability.

Previously, the present inventors studied several kinds of hot forging products of metallographic structures in which a proper amount of bainite structure is mixed with ferrite structure, regarding their fatigue strength and machinability and invented a non-thermal refined ferrite-bainite type steel, usable as hot forged, having improved tensile strength and fatigue strength while keeping the machinability acceptable to the conventional machining step. This study was conducted from the three standpoints of (1) utilizing the complex precipitates as precipitation nuclei of ferrite, (2) lowering of low C and N, and (3) precipitating V carbide into a two-phase structure of ferrite+bainite. However, the steel having a bainite structure as transformed has problems of significantly lowered yield strength and yield ratio although the tensile strength and fatigue strength are improved. Due to these problems, the application, in particular, to automobile engine parts that are subjected to large load irregularity has been difficult.

The present invention is to provide a production process for a hot forged steel having high tensile strength, fatigue strength and good machinability simultaneously, which has been difficult to realize by conventional hot forging steels.

DISCLOSURE OF THE INVENTION

The yield strength equals the stress for starting plastic deformation, and is decided in the case of a two-phase structure of hard phase+soft phase, for example, by the yield strength of the soft phase. Thus, in the case of two-phase structure of ferrite+bainite, the yield strength of the soft ferrite phase, governs. Since the ferrite phase finishes the transformation at a relatively high temperature, the ferrite phase contains smaller amounts of solid-solute C and N than the bainite phase, which is a lower temperature transformation phase, and an aging treatment will not increase the yield strength.

On the other hand, in a material of ferrite+bainite structure where V is contained in some larger amount, a large amount of solid-solute V may exist in the ferrite. When an aging treatment is given to a material that has a ferrite+bainite structure in steel components and has C and N controlled relatively in small amounts, it has been found that fine V carbide precipitates not only in the bainite phase but also in the ferrite phase in conformity with the ferrite matrix. It has also been found that the fine V carbide prevents the movement of dislocation that is introduced by the transformation, which enhances the yield strength and, in addition, improves the fatigue strength without lowering the tensile strength if the aging treatment is done at a proper range of temperature.

On the basis of these findings, the present inventors have completed the present invention that provides a production process, of ideal hot forging for producing a steel that has excellent tensile strength, fatigue strength and machinability by applying an aging treatment at a specified range of temperature to a ferrite+bainite structure steel having specified chemical components.

The first aspect of the present invention is a process for producing a hot forged steel of ferrite+bainite structure type characterized by: applying hot forging to a steel product that has a composition by weight of C: 0.10–0.35%, Si: 0.15–2.00%, Mn: 0.40–2.00%, S: 0.03–0.10%, Al: 0.0005–0.050%, Ti: 0.003–0.050%, N: 0.0020–0.0070%, V: 0.30–0.70%, with the balance being Fe and impurities, finishing the forging at a finishing temperature not less than 1050° C.; cooling thereafter so that 80% or more of the metallographic structure after the transformation is a ferrite+bainite structure; and further applying an aging treatment at a temperature of 200°–700° C. According to the second aspect of the invention, one or two or more elements selected from Cr: 0.02–1.50%, Mo: 0.02–1.00%, Nb: 0.001–0.20%, Pb: 0.05–0.30%, and Ca: 0.0005–0.010%, are added to the above steel for the purpose of making the crystal grains finer, adjusting the ratio of the bainite structure, and improving the machinability further.

The reasons for limiting the chemical components of the steel product, limiting the metallographic structure after the transformation following the hot forging and cooling, and limiting the aging treatment condition are explained below.

C: This element is important for adjusting the structure ratio of bainite structure and accordingly increases tensile strength of the final product. However, an excessive content of this element increases the strength excessively and deteriorates the machinability significantly. When present less than 0.10% it makes both the tensile strength and fatigue strength become too low, but carbon contents exceeding 0.35% make the tensile strength too high, causing the machinability significantly to deteriorate. Thus, the range of 0.10–0.35% is specified.

Si: This element is effective for adjusting deoxidization and the ratio of bainite structure. Si contents less than 0.15% do not give enough effect; and Si contents exceeding 2.00% lower both the durability ratio and machinability. Thus, the range of 0.15–2.00% is specified.

Mn: This element adjusts the ratio of bainite structure and forms MnS that brings a base of composite precipitates, giving the precipitation site for ferrite. Mn contents less than 0.40% do not give enough effect and the contents exceeding 2.00% bring too much generation of bainite causing both the durability ratio and machinability lowered. Thus, the range of 0.40–2.00% is specified.

S: This element forms MnS, bringing a base of composite precipitates, and giving the precipitation site for ferrite and improves the machinability. Specified range is 0.03–0.10%.

Al: The element is effective for deoxidizing and refinement of the crystal grains. A1 contents less than 0.0005% do not give enough effect, and the contents exceeding 0. 050% form hard inclusions, causing both the durability ratio and machinability to lower. Thus, the range of 0.0005–0.050% is specified.

Ti: This element precipitates as nitride on MnS, forming the composite precipitation which gives the precipitation site for ferrite. Its presence less than 0,003% does not give enough effect; the presence exceeding 0.050% promotes formation of coarse hard inclusion causing both durability ratio and machinability to lower. Thus, the range of 0.003–0.05% is specified.

N: This element forms nitrides and carbon nitrides with Ti and V. N contents less than 0.0020% do not give enough effect, and the contents exceeding 0,070% lower both the durability ratio and machinability. Thus, the range of 0.0020–0.0070% is specified.

V: This element forms the composite precipitates with MnS and TiN and reinforces the precipitation of matrix ferrite in bainite. V contents less than 0.30% do not give enough effect and the contents exceeding 0.70% lower both durability ratio and machinability. Thus, the range of 0.30–0.70% is specified.

The above are the reasons for specifying the chemical components in the steel according to the first aspect of the present invention. In the second aspect of the present invention, one or two or more elements selected from Cr, Mo, Pb and Ca are contained in addition to the components of the above steel for the purpose of making the crystal grains finer, adjusting the ratio of bainite structure, and improving the machinability further. The reasons for specifying the chemical components are explained below.

Cr: This element adjusts the ratio of bainite structure in nearly the same way as Mn. Cr contents less than 0.02% do not give enough effect but the contents exceeding 1.50% bring too much formation of bainite, causing both the durability ratio and machinability to lower. Thus, the range of 0.02–1.50% is specified.

Mo: This element has effect similar to Mn and. Cr. Mo contents less than 0.02% do not give enough effect; the contents exceeding 1.00% bring too much generation of bainite causing both the durability ratio and machinability to lower. Thus, the range of 0.02–1.00% is specified.

Nb: The element has effect similar to Mn and Cr. Nb contents less than 0.001% do not give enough effect, and the contents exceeding 0.20% bring too much formation of bainite, causing both durability ratio and machinability to lower. Thus, the range of 0.001–0.20% is specified.

Pb: This element improves the machinability. Pb contents less than 0.05% do not give enough effect; the contents exceeding 0.30% saturate such effect and decreases the fatigue strength and durability ratio. Thus, the range of 0.05–0.30% is specified.

Ca: This element has effect similar to Pb. Ca contents less than 0.0005% do not give enough effect, and the contents exceeding 0,010% saturate such effect and decrease the fatigue strength and durability ratio. Thus, the range of 0.0005–0.010% is specified.

Now, the metallographic structure after the transformation following the hot forging and cooling will be discussed. The metallographic structure is required to contain 80% or more of the two-phase structure of ferrite+bainite in order to improve the machinability and the fatigue structure. The contents of pearlite, martensite, and residual austenite in an amount less than 20% as the structure ratio do not hinder the effects of the present invention.

While the cooling method after hot forging is not limited as long as such ferrite-bainite two phase structure is obtained, natural cooling is preferable in view of facilities and production cost as a matter of course. The metallographic structure is confirmed by observing an etching test piece by an optical microscope or others, and by measuring fine hardness of the structure by a micro-Vickers hardness meter.

Finally, the reason for limiting the condition for the aging treatment of the material will be explained. Diffusion of C is difficult when the heating temperature is lower than 200° C. and the effect becomes insufficient. On the other hand, at a temperature exceeding 700° C., the precipitated carbides become coarse and the tensile strength decreases; in addition, the fatigue strength lowers also. Thus, the heating temperature for the aging treatment is specified as 200°–700° C. As long as the heating temperature is within this range, there is no limitation for the heating period of time; however, preferable period is from 10 minutes to 2 hours or so. Any cooling methods including air cooling, water cooling and oil cooling after the aging treatment will bring the effects of the present invention.

The effects of the present invention are shown more specifically by way of Examples.

BEST MODE FOR CARRYING OUT THE INVENTION

Examples

In the tables below, the conditions enclosed by bold lines are embodying examples satisfying the present invention and the others are comparative examples.

(1) Influence of Chemical Components of Steel Material

Each steel having chemical components shown in Table 1 was melted in a high frequency furnace to make a steel ingot of 150 kg. From this ingot, a material for forging was cut out, normalized once with heating to 950° C. followed by allowing to cool down, heated up to 1100°–1250° C. and subjected to hot forging at a temperature of 1050°–1200° C., and thereafter allowed to cool down. From the center part of this material, a JIS No. 4 tensile test piece and a JIS No. 1 rotary bending test piece were sampled and subjected to the tensile test and rotating bending fatigue test respectively. A specimen for observation by an optical microscope was etched with 5% nital, and observed at a magnification 200 to determine the structure ratio of bainite. A specimen for machinability test was further sampled from the material, and a blind hole of 30 mm depth was bored therein by a 10 mm$^{\phi}$ straight shank drill made of SKH9. Total length of the boring was measured until the drill was broken with life. Machinability was evaluated by the relative total boring length supposing the total boring length of conventional No steel 1.00. The cutting speed was 50 m/min, the feed speed was 0.35 mm/rev, and the cutting oil was 7 L/min.

TABLE 1

| No | | Weight % | | | | | | | | | | | | |
|---|---|---|---|---|---|---|---|---|---|---|---|---|---|---|
| | | C | Si | Mn | S | Al | Ti | N | V | Cr | Mo | Nb | Pb | Ca |
| | | | | | | (Part 1) | | | | | | | | |
| 1 | Embodying Example of the first invention | 0.13 | 1.55 | 1.96 | 0.036 | 0.031 | 0.011 | 0.0051 | 0.55 | — | — | — | — | — |
| 2 | Embodying Example of the first invention | 0.19 | 1.15 | 1.95 | 0.045 | 0.032 | 0.012 | 0.0062 | 0.45 | — | — | — | — | — |
| 3 | Embodying Example of the first invention | 0.24 | 0.98 | 1.94 | 0.054 | 0.035 | 0.015 | 0.0065 | 0.41 | — | — | — | — | — |
| 4 | Embodying Example of the first invention | 0.32 | 0.55 | 1.92 | 0.064 | 0.041 | 0.016 | 0.0065 | 0.35 | — | — | — | — | — |
| 5 | Embodying Example of the first invention | 0.33 | 0.24 | 1.93 | 0.075 | 0.046 | 0.014 | 0.0066 | 0.31 | — | — | — | — | — |
| 6 | Embodying Example of the second invention | 0.27 | 0.35 | 1.97 | 0.056 | 0.038 | 0.016 | 0.0056 | 0.42 | 0.35 | — | — | — | — |
| 7 | Embodying Example of the second invention | 0.31 | 0.29 | 1.98 | 0.057 | 0.035 | 0.012 | 0.0055 | 0.35 | — | 0.21 | — | — | — |
| 8 | Embodying Example of the second invention | 0.28 | 0.22 | 1.99 | 0.056 | 0.025 | 0.014 | 0.0057 | 0.35 | — | — | 0.031 | — | — |
| 9 | Embodying Example of the second invention | 0.31 | 0.26 | 1.95 | 0.055 | 0.026 | 0.016 | 0.0051 | 0.31 | 0.31 | 0.18 | — | — | — |
| 10 | Embodying Example of the second invention | 0.25 | 0.27 | 1.96 | 0.052 | 0.028 | 0.017 | 0.0042 | 0.32 | 0.25 | — | 0.025 | — | — |
| 11 | Embodying Example of the second invention | 0.26 | 0.31 | 1.96 | 0.051 | 0.031 | 0.012 | 0.0048 | 0.33 | — | 0.15 | 0.021 | — | — |
| 12 | Embodying Example of the second invention | 0.25 | 0.35 | 1.97 | 0.045 | 0.025 | 0.014 | 0.0057 | 0.35 | 0.22 | 0.12 | 0.021 | — | — |
| 13 | Embodying Example of the second invention | 0.31 | 0.26 | 1.96 | 0.044 | 0.041 | 0.015 | 0.0056 | 0.31 | — | — | — | 0.22 | — |
| 14 | Embodying Example of the second invention | 0.27 | 0.35 | 1.98 | 0.033 | 0.042 | 0.011 | 0.0058 | 0.36 | — | — | — | — | 0.0018 |
| 15 | Embodying Example of the second invention | 0.25 | 0.20 | 1.95 | 0.035 | 0.043 | 0.013 | 0.0059 | 0.42 | — | — | — | 0.12 | 0.0014 |
| 16 | Embodying Example of the second invention | 0.19 | 0.38 | 1.96 | 0.037 | 0.044 | 0.016 | 0.0061 | 0.39 | 0.31 | — | — | 0.11 | — |
| 17 | Embodying Example of the second invention | 0.29 | 1.36 | 1.96 | 0.041 | 0.035 | 0.017 | 0.0061 | 0.33 | 0.21 | 0.12 | — | — | 0.0016 |
| 18 | Embodying Example of the second invention | 0.27 | 1.12 | 1.97 | 0.046 | 0.038 | 0.014 | 0.0059 | 0.32 | — | 0.11 | 0.012 | 0.12 | — |
| 19 | Embodying Example of the second invention | 0.31 | 0.25 | 1.96 | 0.044 | 0.035 | 0.013 | 0.0060 | 0.37 | — | 0.33 | — | 0.11 | 0.0013 |
| 20 | Embodying Example of the second invention | 0.25 | 0.33 | 1.95 | 0.046 | 0.038 | 0.011 | 0.0055 | 0.33 | 0.32 | — | 0.011 | 0.11 | 0.0013 |
| 21 | Comparative Example | 0.09 | 0.24 | 1.95 | 0.076 | 0.046 | 0.014 | 0.0066 | 0.32 | — | — | — | — | — |
| 22 | " | 0.45 | 0.25 | 1.96 | 0.075 | 0.048 | 0.015 | 0.0065 | 0.31 | — | — | — | — | — |
| 23 | " | 0.28 | 0.07 | 1.95 | 0.045 | 0.033 | 0.012 | 0.0062 | 0.45 | — | — | — | — | — |
| 24 | " | 0.18 | 2.21 | 1.95 | 0.042 | 0.032 | 0.012 | 0.0063 | 0.44 | — | — | — | — | — |
| 25 | " | 0.32 | 0.95 | 0.30 | 0.054 | 0.036 | 0.016 | 0.0065 | 0.41 | — | — | — | — | — |
| 26 | " | 0.25 | 0.91 | 2.15 | 0.054 | 0.035 | 0.015 | 0.0066 | 0.43 | — | — | — | — | — |
| 27 | " | 0.31 | 0.55 | 1.95 | 0.015 | 0.041 | 0.016 | 0.0065 | 0.35 | — | — | — | — | — |
| 28 | " | 0.30 | 0.56 | 1.96 | 0.121 | 0.043 | 0.015 | 0.0063 | 0.34 | — | — | — | — | — |
| | | | | | | (Part 2) | | | | | | | | |
| 29 | " | 0.35 | 0.26 | 1.96 | 0.077 | 0.0002 | 0.013 | 0.0064 | 0.34 | — | — | — | — | — |
| 30 | " | 0.34 | 0.28 | 1.97 | 0.075 | 0.053 | 0.014 | 0.0066 | 0.38 | — | — | — | — | — |
| 31 | " | 0.25 | 0.34 | 1.97 | 0.056 | 0.041 | 0.001 | 0.0056 | 0.41 | — | — | — | — | — |
| 32 | " | 0.26 | 0.35 | 1.95 | 0.056 | 0.038 | 0.061 | 0.0056 | 0.42 | — | — | — | — | — |
| 33 | " | 0.28 | 0.31 | 1.95 | 0.057 | 0.036 | 0.013 | 0.0015 | 0.35 | — | — | — | — | — |
| 34 | " | 0.27 | 0.33 | 1.96 | 0.058 | 0.035 | 0.012 | 0.0078 | 0.35 | — | — | — | — | — |
| 35 | " | 0.31 | 0.22 | 1.96 | 0.057 | 0.026 | 0.014 | 0.0055 | 0.24 | — | — | — | — | — |
| 36 | " | 0.30 | 0.21 | 1.96 | 0.056 | 0.025 | 0.016 | 0.0057 | 0.75 | — | — | — | — | — |
| 37 | " | 0.30 | 0.29 | 1.95 | 0.052 | 0.028 | 0.015 | 0.0042 | 0.32 | 1.61 | — | — | — | — |
| 38 | " | 0.31 | 0.32 | 1.96 | 0.051 | 0.031 | 0.012 | 0.0048 | 0.33 | — | 1.15 | — | — | — |
| 39 | " | 0.24 | 0.35 | 1.97 | 0.032 | 0.025 | 0.014 | 0.0057 | 0.34 | — | — | 0.320 | — | — |
| 40 | " | 0.26 | 0.33 | 1.98 | 0.044 | 0.041 | 0.015 | 0.0055 | 0.31 | — | — | — | 0.33 | — |

TABLE 1-continued

| No | | Weight % | | | | | | | | | | | | |
|---|---|---|---|---|---|---|---|---|---|---|---|---|---|---|
| | | C | Si | Mn | S | Al | Ti | N | V | Cr | Mo | Nb | Pb | Ca |
| 41 | " | 0.28 | 0.34 | 1.96 | 0.033 | 0.042 | 0.011 | 0.0058 | 0.36 | — | — | — | — | 0.0115 |
| 42 | Comparative Example: Conventional thermal refined steel | 0.45 | 0.23 | 0.78 | 0.027 | 0.028 | — | 0.0083 | — | — | — | — | — | — |

Table 2 shows the structure ratio of bainite and results of performance evaluation for each sample.

At first, in contrast with No. 42 that is a thermal refined steel having the durability ratio of 0.47 and machinability of 1.00, all of the Nos. 1 through 20 that are Embodying Examples of the present invention show excellent results having durability ratio of 0.56 or more and two or three times better machinability.

No. 21, a Comparative Example, has a low tensile strength and low fatigue strength since the C content is low. No. 22, a Comparative Example, has martensite formed due to the excessive C content and does not satisfy the required range for structure ratio of bainite according to the present invention; although the tensile strength is high, the durability ratio is low compared with Embodying Examples and the machinability is also poor.

No. 23, a Comparative Example, has a low degree of deoxidation since the Si content is low, and the durability ratio is low compared with Embodying Examples. No. 24, a Comparative Example, has martensite formed due to the excessive Si content and does not satisfy the required range for structure ratio of bainite according to the present invention; the durability ratio is low compared with Embodying Examples and the machinability is also poor.

No. 25, a Comparative Example, has a low composite precipitation since the Mn content is low, and has a poor durability ratio compared with Embodying Examples. No. 26, a Comparative Example, has martensite formed due to excessive Mn content and does not satisfy the required range for structure ratio of bainite according to the present invention; the durability ratio is low compared with Embodying Examples and the machinability is also poor.

No. 27, a Comparative Example, has a low composite inclusion since the S content is low and has a poor durability ratio compared with Embodying Examples; the machinability is also poor since the effect of MnS for improving the machinability is not realized. No. 28, a Comparative Example, has an excessive precipitation of Mns since the S content is high, and has a lower durability ratio compared with the Embodying Examples.

No. 29, a Comparative Example, has a low degree of deoxidation and a smaller effect of making crystals fine since the Al content is low, and has a lower durability ratio compared with the Embodying Examples. No. 30, a Comparative Example, has hard inclusion formed because the Al content is high, and has a lower durability ratio compared with the Embodying Examples; the machinability is also poor.

No. 31, a Comparative Example, has a small composite precipitation because the Ti content is low, and has a lower durability ratio compared with the Embodying Examples. No. 32, a Comparative Example, has hard inclusion formed since the Ti content is high, and has a lower durability ratio compared with the Embodying Examples; the machinability is also poor.

No. 33, a Comparative Example, has a small composite precipitation because the N content is low, and has a lower durability ratio compared with the Embodying Examples. No. 34, a Comparative Example, has the matrix hardened because the N content is high, and has a lower durability ratio compared with the Embodying Examples; the machinability is also poor.

No. 35, a Comparative Example, has a small composite precipitation and has a smaller effect to reinforce precipitation of matrix ferrite because the V content is low; thus, the durability ratio is small compared with the Embodying Examples and the durability ratio is also poor. No. 36, a Comparative Example, has a lower durability ratio compared with the Embodying Examples because the V content is high, and the machinability is also poor.

No. 37, a Comparative Example, has martensite formed due to the excessive Cr content and does not satisfy the required range for structure ratio of bainite according to the present invention; the durability ratio is low compared with Embodying Examples and the machinability is also poor.

No. 38, a Comparative Example, has martensite formed due to the excessive Mo content and do not satisfy the required range for structure ratio of bainite according to the present invention; the durability ratio is low compared with Embodying Examples and the machinability is also poor.

No. 39, a Comparative Example, has a poor durability ratio because the Nb content is high and the machinability is also poor.

No. 40, a Comparative Example, has a poor durability ratio although the machinability is good because the Pb content is high.

No. 41, a Comparative Example, has a poor durability ratio although the machinability is good because the Ca content is high.

TABLE 2

| No | | Ferrite + Bainite Structure Ratio: Inventive Range | Ferrite + Bainite Structure Ratio: Observed | Mechanical Property: Tensile Strength (kgf/mm²) | Mechanical Property: Yield Strength (kgf/mm²) | Mechanical Property: Yield Ratio | Mechanical Property: Fatigue Strength (kgf/mm²) | Mechanical Property: Fatigue Durability Ratio | Machine-ability |
|---|---|---|---|---|---|---|---|---|---|
| | | | | (Part 1) | | | | | |
| 1 | Embodying Example of the First Invention | ≧0.80 | 0.85 | 126.6 | 93.5 | 0.74 | 72.0 | 0.57 | 1.97 |
| 2 | Embodying Example of the First Invention | " | 0.88 | 118.3 | 89.0 | 0.75 | 66.0 | 0.56 | 2.11 |
| 3 | Embodying Example of the First Invention | " | 0.90 | 117.0 | 88.3 | 0.75 | 70.1 | 0.60 | 2.14 |
| 4 | Embodying Example of the First Invention | " | 0.93 | 111.5 | 85.2 | 0.76 | 66.1 | 0.59 | 2.24 |
| 5 | Embodying Example of the First Invention | " | 0.93 | 104.0 | 81.1 | 0.78 | 60.7 | 0.58 | 2.40 |
| 6 | Embodying Example of the Second Invention | " | 0.91 | 113.3 | 86.2 | 0.76 | 67.4 | 0.59 | 2.21 |
| 7 | Embodying Example of the Second Invention | " | 0.92 | 105.8 | 82.1 | 0.78 | 62.0 | 0.59 | 2.36 |
| 8 | Embodying Example of the Second Invention | " | 0.91 | 101.7 | 79.8 | 0.78 | 59.0 | 0.58 | 2.46 |
| 9 | Embodying Example of the Second Invention | " | 0.92 | 108.8 | 83.7 | 0.77 | 64.1 | 0.59 | 2.30 |
| 10 | Embodying Example of the Second Invention | " | 0.90 | 103.1 | 80.6 | 0.78 | 60.0 | 0.58 | 2.43 |
| 11 | Embodying Example of the Second Invention | " | 0.90 | 100.5 | 79.2 | 0.79 | 58.1 | 0.58 | 2.49 |
| 12 | Embodying Example of the Second Invention | " | 0.90 | 105.8 | 82.1 | 0.78 | 62.0 | 0.59 | 2.36 |
| 13 | Embodying Example of the Second Invention | " | 0.92 | 103.0 | 80.5 | 0.78 | 59.9 | 0.58 | 2.67 |
| 14 | Embodying Example of the Second Invention | " | 0.91 | 104.0 | 81.1 | 0.78 | 60.7 | 0.58 | 2.64 |
| 15 | Embodying Example of the Second Invention | " | 0.90 | 101.0 | 79.5 | 0.79 | 58.5 | 0.58 | 2.72 |
| 16 | Embodying Example of the Second Invention | " | 0.88 | 104.5 | 81.4 | 0.78 | 61.0 | 0.58 | 2.63 |
| 17 | Embodying Example of the Second Invention | " | 0.92 | 130.9 | 95.9 | 0.73 | 80.1 | 0.61 | 2.10 |
| 18 | Embodying Example of the Second Invention | " | 0.91 | 119.4 | 89.5 | 0.75 | 71.8 | 0.60 | 2.30 |
| 19 | Embodying Example of the Second Invention | " | 0.92 | 105.5 | 81.9 | 0.78 | 61.7 | 0.59 | 2.61 |
| 20 | Embodying Example of the Second Invention | " | 0.90 | 104.0 | 77.2 | 0.74 | 62.1 | 0.60 | 2.64 |
| 21 | Comparative Example | " | 0.85 | 82.5 | 60.5 | 0.73 | 40.2 | 0.49 | 3.03 |
| 22 | " | " | 0.75 | 131.2 | 98.5 | 0.75 | 58.3 | 0.44 | 0.95 |
| 23 | " | " | 0.91 | 102.1 | 80.1 | 0.78 | 50.2 | 0.49 | 2.45 |
| 24 | " | " | 0.77 | 140.8 | 109.9 | 0.78 | 73.8 | 0.52 | 0.88 |
| 25 | " | " | 0.92 | 94.0 | 75.6 | 0.80 | 45.2 | 0.48 | 2.66 |
| 26 | " | " | 0.75 | 132.3 | 105.2 | 0.80 | 61.7 | 0.47 | 0.85 |
| 27 | " | " | 0.92 | 111.1 | 85.0 | 0.77 | 55.7 | 0.50 | 0.77 |
| | | | | (Part 2) | | | | | |
| 28 | " | " | 0.93 | 110.2 | 84.5 | 0.77 | 55.1 | 0.50 | 3.35 |

TABLE 2-continued

| No | | Ferrite + Bainite Structure Ratio Inventive Range | Observed | Mechanical Property Tensile Strength (kgf/mm²) | Yield Strength (kgf/mm²) | Yield Ratio | Fatigue Strength (kgf/mm²) | Durability Ratio | Machine-ability |
|---|---|---|---|---|---|---|---|---|---|
| 29 | " | " | 0.94 | 107.9 | 83.3 | 0.77 | 53.7 | 0.50 | 2.32 |
| 30 | " | " | 0.95 | 109.5 | 84.1 | 0.77 | 54.7 | 0.50 | 0.88 |
| 31 | " | " | 0.91 | 104.1 | 81.1 | 0.78 | 51.4 | 0.49 | 2.40 |
| 32 | " | " | 0.94 | 105.3 | 81.8 | 0.78 | 52.1 | 0.50 | 0.87 |
| 33 | " | " | 0.93 | 103.0 | 80.6 | 0.78 | 50.7 | 0.49 | 2.43 |
| 34 | " | " | 0.92 | 102.8 | 80.4 | 0.78 | 50.6 | 0.49 | 0.96 |
| 35 | " | " | 0.91 | 98.9 | 78.3 | 0.79 | 48.2 | 0.49 | 2.53 |
| 36 | " | " | 0.94 | 120.8 | 90.3 | 0.75 | 61.6 | 0.51 | 0.95 |
| 37 | " | " | 0.72 | 134.1 | 97.6 | 0.73 | 69.7 | 0.52 | 0.85 |
| 38 | " | " | 0.71 | 125.3 | 95.5 | 0.76 | 52.1 | 0.42 | 0.84 |
| 39 | " | " | 0.91 | 100.2 | 79.0 | 0.79 | 49.0 | 0.49 | 0.88 |
| 40 | " | " | 0.92 | 100.4 | 79.1 | 0.79 | 49.1 | 0.49 | 2.74 |
| 41 | " | " | 0.91 | 104.3 | 81.3 | 0.78 | 51.5 | 0.49 | 2.64 |
| 42 | " | (QT Structure) | | 81.3 | 65.9 | 0.81 | 38.2 | 0.47 | 1.00 |

(2) Influence of Cooling Method After Hot Forging on the Ratio of Ferrite+Bainite Structure Each steel having chemical components shown in Table 1 was melted in a high frequency furnace to make a steel ingot of 150 kg. From this ingot, a material for forging was cut out, normalized once with heating at a temperature of 950° C. followed by allowing to cool down, heated up to 1100°–1250° C. and subjected to hot forging at a temperature of 1050°–1200° C., and thereafter allowed to cool down in a way as shown in Table 3. Furthermore, these products were subjected an aging treatment by charging them into a heating furnace at a temperature of 400° C. for 1 hour. From the center part of this material, the tensile strength, fatigue strength, machinability and ratio of ferrite+bainite structure were determined in the same procedures as Embodying Example 1. Table 4 shows the ratio of bainite structure and results of performance evaluation for each sample.

Nos. 43, 44, 45 and 46 all have 0.8 or higher of the ratio of ferrite+bainite structure satisfying the requirement according to the present invention; all have good machinability nearly 2.5 times as high as No. 48, a conventional thermal refined steel, while the durability ratio is kept 0.56 or more.

No. 47 has a structure mainly composed of martensite by increasing the cooling speed; while the tensile strength is enhanced, the durability ratio is extremely low and the machinability is poor with short tool life.

TABLE 3

| No | Sample Steel | Cooling Method After Forging | Average Cooling Speed at 800–500° C. |
|---|---|---|---|
| 43 | No. 20 of Table 1 | Slow cooling in glass wool insulating material | Ca. 0.30° C./Sec. |
| 44 | " | Natural cooling | Ca. 0.80° C./Sec. |
| 45 | " | Cooling in breeze | Ca. 1.40° C./Sec. |
| 46 | " | Quenching by water mist injection | Ca. 4.00° C./Sec. |
| 47 | " | Thrown into oil hardening bath, quench hardening | Ca. 30.00° C./Sec. |
| 48 | No. 42 of Table 1 Control Steel: Conventional thermal refined steel | Oil hardening at 875° C., tempering at 570° C., then water cooling | — |

TABLE 4

| No | Sample Steel | Ferrite + Bainite Structure Ratio Inventive Range | Observed | Mechanical Property Tensile Strength (kgf/mm²) | Yield Strength (kgf/mm²) | Yield Ratio | Fatigue Strength (kgf/mm²) | Durability Ratio | Machine-ability |
|---|---|---|---|---|---|---|---|---|---|
| 43 | Embodying Example | ≧0.80 | 0.88 | 100.5 | 72.5 | 0.72 | 58.8 | 0.59 | 2.74 |
| 44 | " | ≧0.80 | 0.90 | 104.0 | 77.2 | 0.74 | 62.1 | 0.60 | 2.64 |
| 45 | " | ≧0.80 | 0.92 | 108.2 | 82.5 | 0.76 | 60.5 | 0.56 | 2.54 |
| 46 | " | ≧0.80 | 0.85 | 115.1 | 87.8 | 0.76 | 64.5 | 0.56 | 2.39 |
| 47 | Comparative Example | ≧0.80 | 0.61 | 1221.2 | 95.8 | 0.79 | 60.5 | 0.50 | 1.25 |
| 48 | (QT Structure) | ≧0.80 | 0.00 | 81.3 | 65.9 | 0.81 | 38.2 | 0.47 | 1.00 |

(3) Influence of Change of Aging Treatment Temperature

The steel having the same chemical components as Embodying Example 2 was melted in a high frequency furnace to make a steel ingot of 150 kg. From this ingot, a material for forging was cut out, normalized once with heating at a temperature of 950° C. followed by allowing to cool down, heated up to 1100°–1250° C. and subjected to hot forging at a temperature of 1050°–1200° C., and thereafter allowed to cool down. Furthermore, samples of this product were subjected to an aging treatment by charging them into a heating furnace at a temperature shown in Table 5 for 1 hour. For these materials, the tensile strength, fatigue strength, and machinability were determined and observation of the metallographic structure was made by the same procedures as Embodying Example 1. Table 6 shows the results of performance evaluation for each sample.

Nos. 50, 51 and 52 all satisfy the requirement range of 200°–700° C. for the aging treatment temperature and have good machinability nearly 2.5 times as high as No. 54, a conventional thermal refined steel, while the durability ratio is kept 0.58 or more.

In the case of No. 49, the aging treatment temperature was lower than the range specified in the present invention and the durability ratio is poor. In the case of No. 53, the aging treatment temperature was higher than the range specified in the present invention and the durability ratio is poor.

TABLE 5

| No | Sample Steel | Tempering Condition |
|---|---|---|
| 49 | No. 20 of Table 1 | 100° C. × 1 hr → Water Cooling |
| 50 | " | 300° C. × 1 hr → Water Cooling |
| 51 | " | 400° C. × 1 hr → Water Cooling |
| 52 | " | 600° C. × 1 hr → Water Cooling |
| 53 | " | 720° C. × 1 hr → Water Cooling |
| 54 | No. 42 of Table 1 Control Steel: Conventional thermal refined steel | Oil hardening at 875° C., tempering at 570° C., then water cooling |

TABLE 6

| | | Ferrite + Bainite Structure Ratio | | Mechanical Property | | | | | |
|---|---|---|---|---|---|---|---|---|---|
| | | | | Tensile | Yield | | Fatigue | | |
| No | Sample Steel | Inventive Range | Observed | Strength (kgf/mm²) | Strength (kgf/mm²) | Yield Ratio | Strength (kgf/mm²) | Durability Ratio | Machine-ability |
| 49 | Comparative Example | ≧0.80 | 0.90 | 108.1 | 65.1 | 0.60 | 55.4 | 0.51 | 2.54 |
| 50 | Emboding Example | ≧0.80 | 0.90 | 106.4 | 75.6 | 0.71 | 62.1 | 0.58 | 2.58 |
| 51 | Emboding Example | ≧0.80 | 0.90 | 104.0 | 77.2 | 0.74 | 62.1 | 0.60 | 2.64 |
| 52 | Emboding Example | ≧0.80 | 0.90 | 100.5 | 77.1 | 0.77 | 59.5 | 0.59 | 2.74 |
| 53 | Comparative Example | ≧0.80 | 0.90 | 95.1 | 72.1 | 0.76 | 47.0 | 0.49 | 2.89 |
| 54 | (QT Structure) | ≧0.80 | 0.00 | 81.3 | 65.9 | 0.81 | 38.2 | 0.47 | 1.00 |

INDUSTRIAL APPLICABILITY

As described above, the invention provides process for producing an ideal hot forged steel; the steel according to the present invention has high tensile strength while keeping the machinability by forming a two-phase structure of ferrite+bainite. Furthermore, the steel is able to have improved durability ratio, namely fatigue strength, without sacrificing the machinability by realization of fine metallographic structure by use of composite precipitates formed by MnS, Ti nitride and V nitride and by simultaneous realization of reinforcement of the ferrite matrix in bainite by V carbide (or carbon nitride); and the steel further has high yield strength by maintaining high V and low C and N before the aging treatment. Thus, great industrial effects are realized.

What is claimed is:

1. A process for producing a hot forged steel of ferrite +bainite structure type usable as structural steel in an as hot forged and aged condition, and having excellent fatigue strength, yield strength and machinability, which process comprises:

applying hot forging to a steel material comprising, by weight,

C: 0.10–0.35%,

Si: 0.15–2.00%,

Mn: 0.40–2.00%,

S: 0.03–0.10%,

Al: 0.0005–0.050%,

Ti: 0.003–0.050%,

N: 0.0020–0.0070%,

V: 0.30–0.70%, and with the balance being Fe and impurities, wherein the finishing temperature of the forging is not less than 1050° C.;

cooling the steel thereafter so that 80% or more of the metallographic structure after transformation is ferrite+bainite structure; and applying an aging treatment to the steel at a temperature of 200°–700° C. to precipitate VC and VN.

2. A process according to claim 1, wherein said steel further comprises one or more elements selected from the group consisting of Cr: 0.02–1.50%, Mo: 0.02–1.00%, Nb: 0.001–0.20%, Pb: 0.05–0.30%, and Ca: 0.0005–0.010%.

* * * * *